US010732562B2

(12) United States Patent
Song

(10) Patent No.: US 10,732,562 B2
(45) Date of Patent: Aug. 4, 2020

(54) WASTE TONER COLLECTING DEVICE AND IMAGE FORMING APPARATUS HAVING THE SAME

(71) Applicant: HEWLETT-PACKARD DEVELOPMENT COMPANY, L.P., Spring, TX (US)

(72) Inventor: Sung-Weon Song, Hwaseong-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/446,005

(22) Filed: Jun. 19, 2019

(65) Prior Publication Data

US 2019/0310582 A1 Oct. 10, 2019

Related U.S. Application Data

(63) Continuation of application No. PCT/KR2017/007686, filed on Jul. 18, 2017.

(30) Foreign Application Priority Data

Dec. 27, 2016 (KR) ..... 10-2016-0180371

(51) Int. Cl.

| | |
|---|---|
| ***G03G 21/12*** | (2006.01) |
| ***G03G 21/10*** | (2006.01) |
| ***G03G 15/00*** | (2006.01) |
| ***G03G 15/20*** | (2006.01) |

(52) U.S. Cl.
CPC ..... *G03G 21/12* (2013.01); *G03G 15/00* (2013.01); *G03G 15/20* (2013.01); *G03G 21/10* (2013.01); *G03G 21/105* (2013.01)

(58) Field of Classification Search
None
See application file for complete search history.

(56) References Cited

U.S. PATENT DOCUMENTS

| | | | | |
|---|---|---|---|---|
| 9,244,427 | B2 * | 1/2016 | Sato | G03G 21/1623 |
| 2012/0237230 | A1 | 9/2012 | Karasawa et al. | |

FOREIGN PATENT DOCUMENTS

| | | | |
|---|---|---|---|
| JP | 2003255792 | A | 9/2003 |
| JP | 2006133397 | A | 5/2006 |
| JP | 2008134381 | A | 6/2008 |
| JP | 2010107901 | A | 5/2010 |
| JP | 2012037860 | A | 2/2012 |
| KR | 1020040110339 | A | 12/2004 |
| KR | 1020080072367 | A | 8/2008 |

OTHER PUBLICATIONS

JP_2012037860_A_T Machine Translation, Japan, Kawasaki, 2012.*

* cited by examiner

*Primary Examiner* — Victor Verbitsky
(74) *Attorney, Agent, or Firm* — Staas & Halsey LLP

(57) ABSTRACT

A waste toner collecting device for an image forming apparatus includes a waste toner bottle for collecting a waste toner, and a leveling unit disposed inside the waste toner bottle to level waste toner collected and piled inside the waste toner bottle.

16 Claims, 18 Drawing Sheets

WASTE TONER COLLECTING DEVICE AND IMAGE FORMING APPARATUS HAVING THE SAME

CROSS-REFERENCE TO RELATED APPLICATIONS

This application is a continuation of International Application PCT/KR2017/007686 filed on Jul. 18, 2017, which claims the priority benefit of Korean Patent Application No. 10-2016-0180371, filed on Dec. 27, 2016. Both the International Application and the Korean Patent Application are incorporated by reference herein in their entirety.

BACKGROUND

Described herein is an image forming apparatus, for example an image forming apparatus having a waste toner collecting device which includes a leveling unit for uniformly distributing waste toner in a waste toner bottle.

DETAILED DESCRIPTION

Examples described hereinafter are for understanding of the disclosure, and it should be understood that various changes can be made to examples described herein and the disclosure can be embodied in different forms. In addition, in the following description, detailed descriptions of well-known functions or configurations will be omitted since they would unnecessarily obscure the disclosure. In addition, it should be noted that the drawings as attached are for understanding of the disclosure, and are not necessarily illustrated to scale, and dimensions of some elements may be exaggerated.

Generally, an image forming apparatus is an apparatus for developing a black and white image or a color image on a printing medium such as paper according to an image signal, and the image forming apparatus includes a laser printer, an inkjet printer, a copier, a multifunction device, a facsimile, and the like.

An electrophotographic image forming apparatus outputs a predetermined image by forming an electrostatic latent image to a visible toner image by attaching a toner to a photosensitive body or an intermediate transfer device having the electrostatic latent image formed thereon, and then transferring the toner image onto a paper.

When a toner image is transferred from the photosensitive body or the intermediate transfer device to a paper, a non-transferred toner (hereinafter, referred to as a "waste toner") remains in a photosensitive medium. The waste toner has a bad influence on a next image, and it is necessary to remove the waste toner. Accordingly, the electrophotographic image forming apparatus may include a waste toner collecting device for collecting waste toner which has not been transferred by the photosensitive body or the intermediate transfer device and remains.

An image forming apparatus may include a cleaning member for physically scraping waste toner remaining on a surface of a photosensitive body and a waste toner conveying auger for conveying the waste toner scraped by the cleaning member to a waste toner collecting bottle by rotation. The conveyed waste toner is discharged to a waste toner collecting device after passing through a waste toner discharging outlet formed at one end of the waste toner collecting device.

Figure 1:
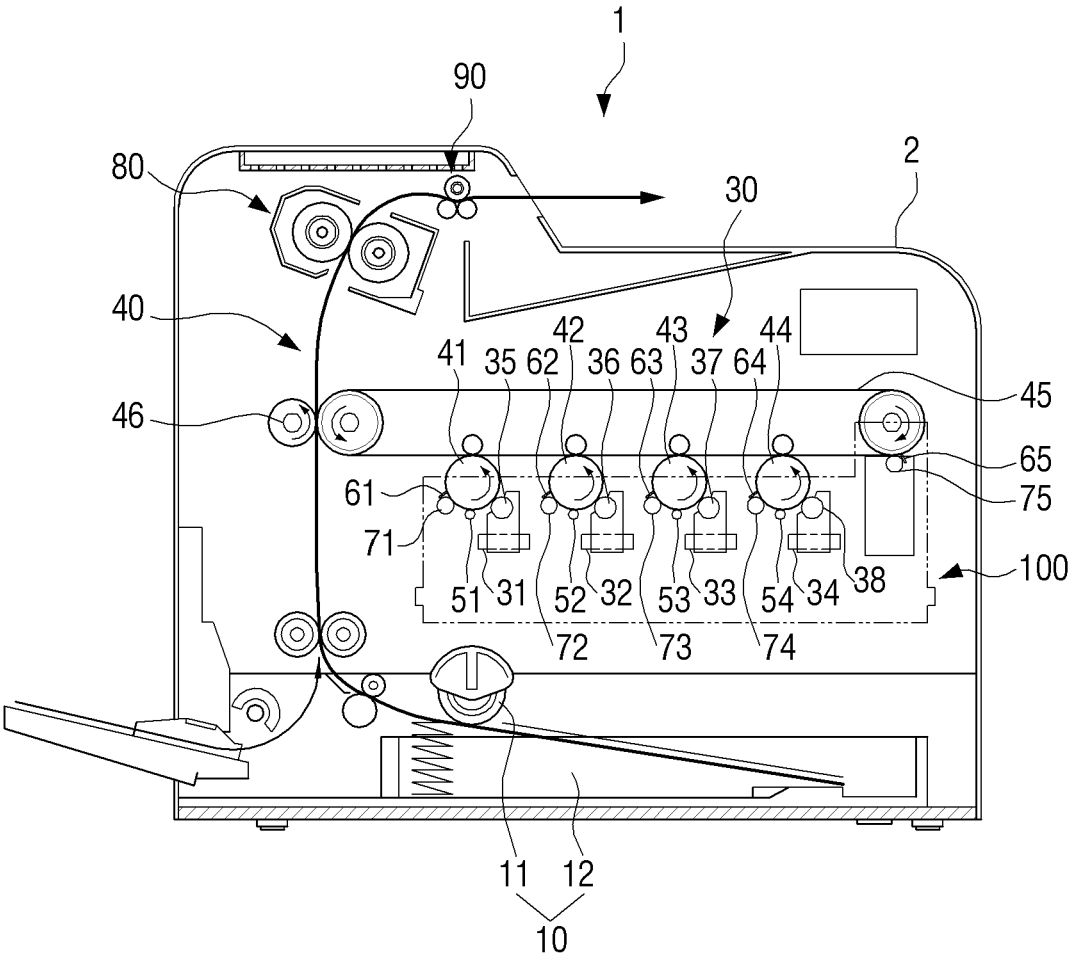
FIG. 1 is a cross-sectional view illustrating an image forming apparatus according to an example.

Referring to FIG. 1, an image forming apparatus 1 according to an example will be described briefly, and then a waste toner collecting device 100 will be described in detail.

FIG. 1 is a cross-sectional view briefly illustrating an image forming apparatus according to an example.

The image forming apparatus 1 includes a main body 2, a paper feeding unit 10, an image forming unit 30, a fusing unit 80, a paper discharging unit 90, and the waste toner collecting device 100.

The main body 2 forms an outer appearance of the image forming apparatus 1 and includes therein the paper feeding unit 10, the image forming unit 30, the fusing unit 80, the paper discharging unit 90, and the waste toner collecting device 100.

The paper feeding unit 10 installed inside the main body 2 feeds the printing medium P to the image forming unit 30, and includes a paper feeding cassette 12 and a pickup roller 11. The image forming unit 30 forms a predetermined image on the fed printing medium P. The fusing unit 80 fuses a visible image onto the printing medium. The paper discharging unit 90 discharges the printing medium to the outside. The waste toner collecting device 100 is for collecting waste toner removed from each of photosensitive bodies 41, 42, 43, and 44 and the intermediate transfer belt 45.

The image forming unit 30 forms a predetermined image on the printing medium P fed from the paper feeding unit 10 and includes optical scanning devices 31, 32, 33 and 34, photosensitive bodies 41, 42, 43, and 44, developing cartridges 35, 36, 37, and 38, and a transfer unit 40.

The plurality of optical scanning devices 31, 32, 33, and 34 scan with a predetermined beam corresponding to print data in accordance with a print command, the plurality of photosensitive bodies 41, 42, 43, and 44 form the electrostatic latent image by receiving beam from the optical scanning devices 31, 32, 33, and 34, the developing cartridges 35, 36, 37, and 38 form a visible image by attaching a toner to each of the photosensitive bodies 41, 42, 43, and 44, and the transfer unit 40 transfers the visible image to the printing medium.

Here, each of the developing cartridges 35, 36, 37, and 38 makes visible images of different colors by storing toners of different colors (for example, yellow, magenta, cyan, and black), and attaching toners to each of the photosensitive bodies 41, 42, 43, 44 having the electrostatic latent image formed thereon.

The transfer unit 40 includes an intermediate transfer belt 45 for generating a color visible image by overlapping the visible images formed in each photosensitive body 41, 42, 43, and 44, and a final transfer roller 46 for transferring the color visible image formed on the intermediate transfer belt 45 to the printing medium. In the intermediate transfer belt 45, the visible images formed at each photosensitive body 41, 42, 43, and 44 are sequentially transferred and overlapped with each other, and the visible images formed on each photosensitive bodies 41, 42, 43, and 44 are transferred to the intermediate transfer belt 45.

In the image forming apparatus according to an example, when printing is begun, a plurality of charging rollers 51, 52, 53, and 54 which are installed adjacent to the photosensitive bodies 41, 42, 43, and 44 charge a surface of the photosensitive bodies 41, 42, 43, and 44 with a predetermined potential.

A beam generated by the plurality of optical scanning devices 31, 32, 33, and 34 is scanned on the photosensitive bodies 41, 42, 43, and 44 according to an image signal, and an electrostatic latent image is formed on the surface of the photosensitive bodies 41, 42, 43, and 44 by a potential difference. Thereafter, the developing cartridges 35, 36, 37, and 38 attach the toner to the photosensitive bodies 41, 42, 43, and 44, and visible images of different colors are formed on the photosensitive bodies 41, 42, 43, and 44. As such, the visible images formed on the photosensitive bodies 41, 42, 43, and 44 are subsequently transferred onto the surface of the intermediate transfer belt 45 by the intermediate transfer rollers and overlapped thereon, and a color visible image composed of powder toner in four colors is formed on the intermediate transfer belt 45.

At the same time, when the printing medium picked up by a pickup roller 11 in the paper feeding unit 10 is conveyed to the visible image transfer position between the intermediate transfer belt 45 and the final transfer roller 46, the color visible image formed on the intermediate transfer belt 45 is transferred to the printing medium by the final transfer roller 46. The color visible image transferred to the printing medium is fixed to the surface of the printing medium by receiving heat and pressure while passing through the fusing unit 80, and the printing medium having passed through the fusing unit 80 is discharged to outside of the main body 2 of the image forming apparatus by the paper discharging unit 90.

In the meantime, cleaning members 61, 62, 63, and 64 are installed near the photosensitive bodies 41, 42, 43, and 44 and the intermediate transfer belt 45, and remove the remaining toner that has not been transferred from photosensitive bodies 41, 42, 43, and 44, and the intermediate transfer belt 45. The cleaning members 61, 62, 63, 64 and 65 physically scrape and remove the waste toner remaining on an outer circumferential surface of the photosensitive body or the intermediate transfer belt 45 after the transfer of the toner to the printing medium P is completed. Waste toner conveying augers 71, 72, 73, 74, and 75 for conveying the cleaned waste toner to the waste toner collecting device 100 are installed between each photosensitive body 41, 42, 43, and 44 and the intermediate transfer belt 45. The waste toner conveying augers 71, 72, 73, 74 and 75 are rotated by the rotational driving force of each of the photosensitive bodies 41, 42, 43, and 44 and the intermediate transfer belt 45. One side of the waste toner conveying augers 71, 72, 73, 74 and 75 is coupled to waste toner inlet holes 105, 106, 107, 108 and 109 (see FIG. 3 and FIG. 5) provided in the waste toner collecting device 100. By this configuration, the waste toner removed from the photosensitive bodies 41, 42, 43, and 44 and the intermediate transfer belt 45 by the cleaning members 61, 62, 63, 64, and 65 is conveyed to a direction (the direction in which the paper is drawn out) by the rotation of the waste toner conveying augers 71, 72, 73, 74, and 75 in a shape of a screw, and the conveyed waste toner passes through the waste toner inlet holes 105, 106, 107, 108, and 109 (see FIG. 3 and FIG. 5) and is collected in the waste toner bottle 101.

Figure 2:
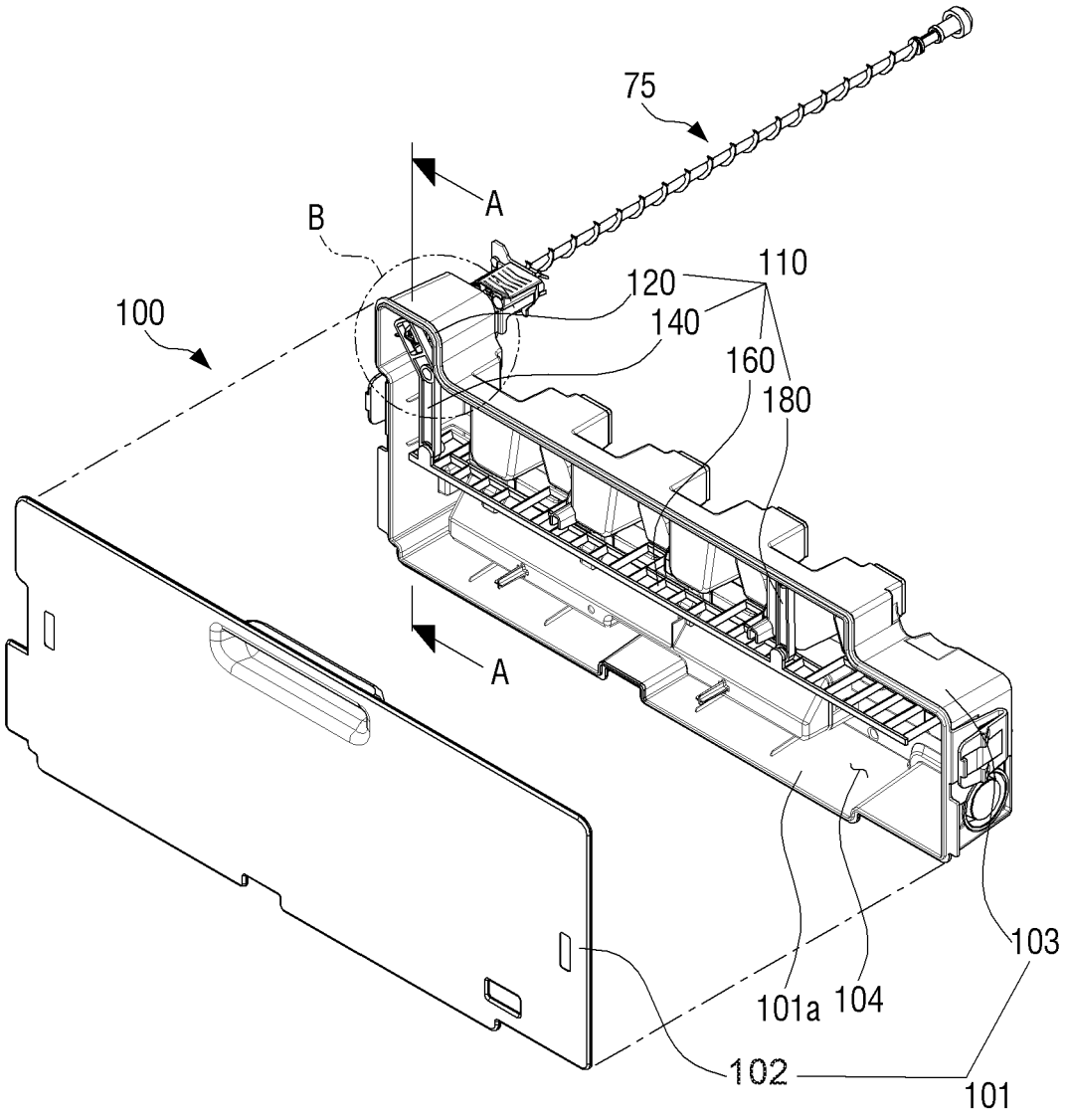
FIG. 2 is an exploded perspective view illustrating a waste toner collecting device of an image forming apparatus according to an example.
Figure 3:
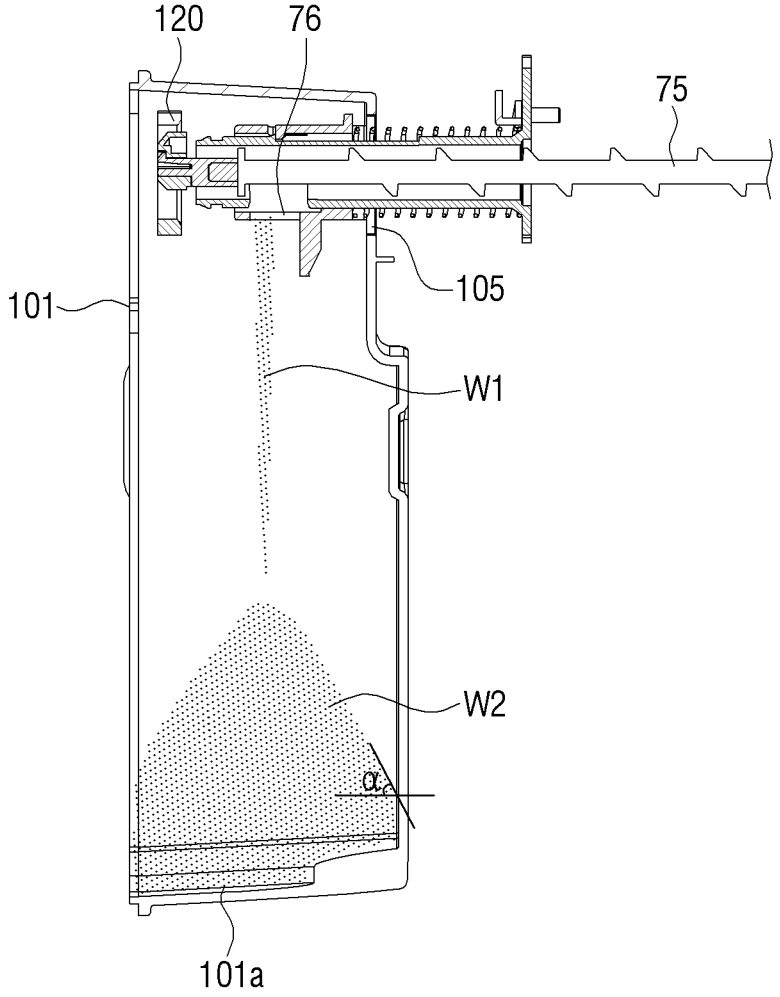
FIG. 3 is a cross-sectional view which is illustrated along A-A line of FIG. 2.

FIG. 2 is an exploded perspective view illustrating a waste toner collecting device of an image forming apparatus according to an example, and FIG. 3 is a cross-sectional view which is illustrated along A-A line of FIG. 2.

Referring to FIG. 2, the cleaning members 61, 62, 63, and 64 and the waste toner conveying auger 75 are provided in the main body 2 of the image forming apparatus 1. The waste toner remaining on the outer circumferential surface of the photosensitive bodies 41, 42, 43, 44 or the intermediate transfer belt 45 after the transfer to the printing medium P is removed by the cleaning members 61, 62, 63, 64, and 65, or the like which are in contact with the outer circumferential surface of the photosensitive bodies 41, 42, 43, 44 or the intermediate transfer belt 45. The removed waste toner is conveyed in one direction by the rotation of the waste toner conveying auger 75 in the form of a screw and collected in the waste toner collecting device 100. When the waste toner collecting device 100 is filled up and the space for storing waste toner becomes insufficient, the waste toner collecting device 100 is detached from the main body 2 and replaced. The waste toner collecting device 100 is detachably coupled to the main body 2 so that the waste toner collecting device can be replaced.

A plurality of photosensitive bodies 41, 42, 43, and 44 and the intermediate transfer belt 45 include the same cleaning member 61, 62, 63, 64, and 65, and the waste toner conveying augers 71, 72, 73, 74, and 75, respectively. For convenience of description, the waste toner conveying auger 75 of the intermediate transfer belt 45 is illustrated and described in FIG. 2. The waste toner conveying auger 75 moves the waste toner removed from the intermediate transfer belt 45 to the waste toner collecting device 100 along the axial direction of the intermediate transfer belt 45.

The waste toner collecting device 100 is detachably installed on one side of the main body 2 of the image forming apparatus 1. The waste toner collecting device 100 includes the waste toner bottle 101 for collecting waste toner. One end of the waste toner bottle 101 is formed with a waste toner inlet hole 105 through which the waste toner conveyed by the waste toner conveying auger 75 flows into the waste toner bottle 101.

For example, referring to FIG. 3, the waste toner conveying auger 75 passes through the waste toner inlet hole 105, and a waste toner outlet 76 is disposed at a lower end of the waste toner conveying auger 75 disposed in the waste toner collecting device 100. The waste toner is vertically discharged from the waste toner outlet 76 to the bottom surface 101*a* of the waste toner bottle 101. While the waste toner is falling from the waste toner outlet 76 to the bottom surface 101*a* of the waste toner bottle 101, the waste toner is piled in a shape of a cone. At this time, an angle formed between an inclined surface of the waste toner heap W2 and the bottom surface 101*a* of the waste toner bottle 101 is referred to as a repose angle α of the waste toner. The repose angle α is the maximum angle at which the waste toner does not slip down.

As the waste toner forms the cone-shaped heap W2 having the repose angle α, even though the waste toner bottle 101 of the waste toner collecting device 100 is not filled up, if a top of the waste toner heap rises up to the waste toner outlet 76, the waste toner collecting device 100 needs to be replaced.

Therefore, according to an example, the waste toner collecting device 100 includes a leveling unit 110 inside the waste toner bottle 101. The leveling unit 110 may level the waste toner W1 which is collected and piled in the waste toner bottle 101, while swinging.

The leveling unit 110 includes a cam member 120, a swing member 140, a shaking member 160, and an auxiliary swing member 180.

The swing member 140 is swingably disposed in the waste toner bottle 101.

The cam member 120, while rotating inside the waste toner bottle 101, is in contact with the swing member 140 and swings the swing member.

The auxiliary swing member 180 is swingably disposed inside the waste toner bottle 101 with an interval with the swing member 140.

One side of the shaking member 160 is hinge-connected to the swing member 140, and the other side is hinge-connected to the auxiliary swing member 180, and the shaking member 160 scrapes an upper portion of the waste toner heap collected into the waste toner bottle.

Hereinafter, each member will be described in a detail.

Figure 4:
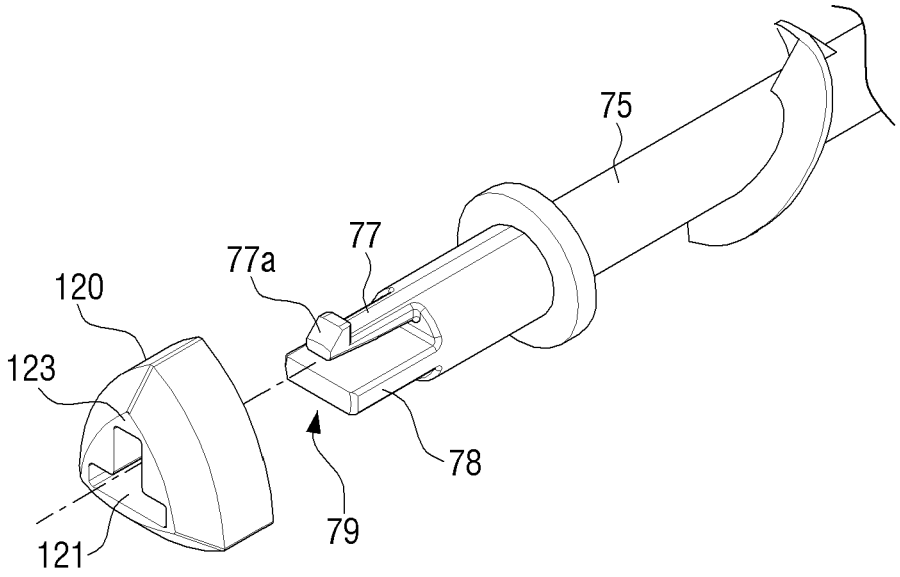
FIG. 4 is an enlarged exploded perspective view illustrating an internal side of the part B of FIG. 2.

FIG. 4 is an enlarged exploded perspective view illustrating an internal side of the part B of FIG. 2.

Referring to FIG. 4, the cam member 120 which rotates inside the waste toner bottle 101 is coupled to an end of the waste toner conveying auger 75. When the waste toner conveying auger 75 rotates in a direction, the cam member 120 rotates along with the waste toner conveying auger 75 in the same direction.

The waste toner conveying auger 75 is rotatably installed at one side of the intermediate transfer belt 45. The waste toner conveying auger 75 rotates by receiving a driving force through a gear coupled to a rotational axis of the intermediate transfer belt 45.

The cam member 120 rotates by utilizing a driving force of a driving motor (not shown) installed in an existing image forming apparatus and does not need a separate driving motor for driving the cam member 120. Therefore, a manufacturing cost is saved.

The cam member 120 is rotatably installed at one side of the waste toner bottle 101 of the waste toner collecting device 100. For example, the cam member 120 is configured such that the cam member 120 is coupled with the waste toner conveying auger and receives a driving force from the driving motor of the image forming apparatus 1 to rotate. FIG. 4 illustrates that the cam member 120 is coupled to the waste toner conveying auger 75 that is connected to the rotational axis of the intermediate transfer belt 45 for driving. However, it is not limited thereto, and the cam member 120 may be coupled with the waste toner conveying auger which is connected to the rotational axis of the photosensitive bodies 41, 42, 43, and 44 for driving.

At one end of the waste toner conveying auger 75 disposed in the waste toner collecting device 100, a coupling member 79 which is coupled with the cam member 120 is formed. At a center of the cam member 120, a coupling hole 121 for coupling with the coupling member 79 of the waste toner conveying auger 75 is formed. The coupling hole 121 is formed in a shape of "T".

The coupling member 79 is composed of a first coupling member 77 and a second coupling member 78 which is formed apart from the first coupling member 77. The first coupling member 77 is formed to have a narrower width than the second coupling member 78 so that the coupling member 79 corresponds to the shape of the coupling hole 121. A snap protrusion 77*a* protruding upward of the first coupling member 77 is formed at the end of the first coupling member 77 so that the coupling member 79 is inserted into the coupling hole 121 and then fixed.

The first coupling member 77 and the second coupling member 78 may be snap-fit coupled and inserted to the coupling hole 121.

The cam member 120 rotates together with the waste toner conveying auger 75 without running idle with respect to the waste toner conveying auger 75 by the second coupling member 78. The snap protrusion 77*a* of the first coupling member 77 inserted into a coupling hole 121 passes through the coupling hole 121 of the cam member 120 to support a front surface 123 of the cam member 120. The cam member 120 is fixedly coupled to the waste toner conveying auger 75 by the snap-coupling of the cam member 120 by the coupling member 79 and rotates together with the waste toner conveying auger 75.

Figure 5:
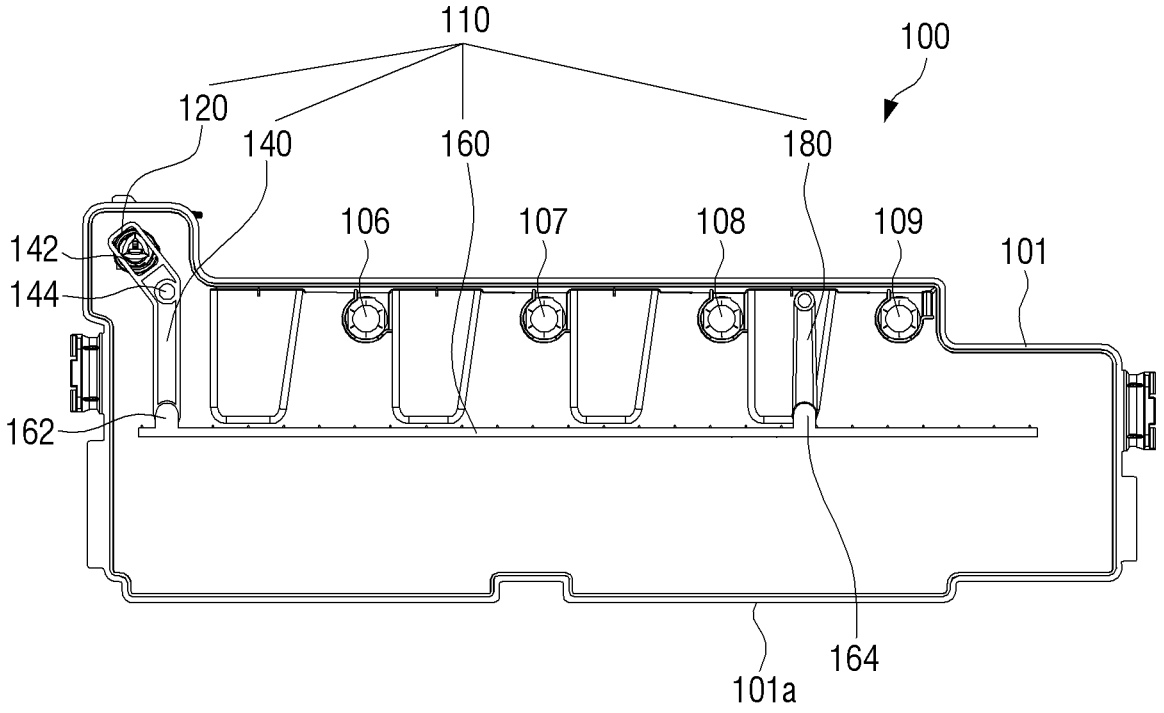
FIG. 5 is a front view illustrating an inside of a first case of a waste toner collecting device according to an example.

FIG. 5 is a front view illustrating an inside of a first case of a waste toner collecting device according to an example.

Referring to FIG. 5, the leveling unit 110 includes a swing member 140 swingably disposed in the waste toner bottle 101, the cam member 120 which is in contact with the swing member 140 to swing the swing member, an auxiliary swing member 180 swingably disposed in the waste toner bottle 101 so as to be spaced apart from the swing member 140, and the shaking member 160 which scrapes an upper portion of the waste toner heap W2 which is collected into the waste toner bottle.

Hereinbelow, referring to FIGS. 6 to 11, each member will be described in a greater detail.

The cam member 120 is to swing the swing member 140 in the waste toner bottle 101, and transfers a rotational driving force of the cam member 120 to the swing member 140.

The cam member 120 is connected to one end of the waste toner conveying auger 75 and rotates along with the waste toner conveying auger 75. A separate driving source dedicated for the leveling unit to rotate the cam member 120 is not necessary. Utilizing a driving force which is already provided in the image forming apparatus, the cam member 120 may be rotated. The cam member 120 may enable leveling of the waste toner collecting device 100 using a single-direction rotational driving force among the existing driving forces.

The cam member 120 is formed in a shape of the Reuleaux triangle which is a figure with constant width w, even when the width w is measured at whatever position. The cam member 120 uses the concept of the Reuleaux triangle. When the Reuleaux triangle is rotated with a fixed rotational center, the Reuleaux triangle may generate a deviation while maintaining the same width w. Accordingly, the cam member 120 may be in contact with the swing member 140, which will be described later, and swing the swing member.

The swing member 140 is for leveling the waste toner by scraping the upper portion of the waste toner heap through swing movement. The swing member 140 rotates in a predetermined range with a predetermined cycle by the rotation of the cam member 120. That is, the swing member 140 swings in the waste toner bottle 101 by the rotation of the cam member 120.

The swing member 140 is rotatably connected to the waste toner bottle 101. The swing member 140 swings with respect to a rotational center 144 of the swing member by the rotation of the cam member 120. In the swing member 140, a cam hole 142, in which the cam member 120 which is capable of contacting is inserted, is formed.

Figure 6:
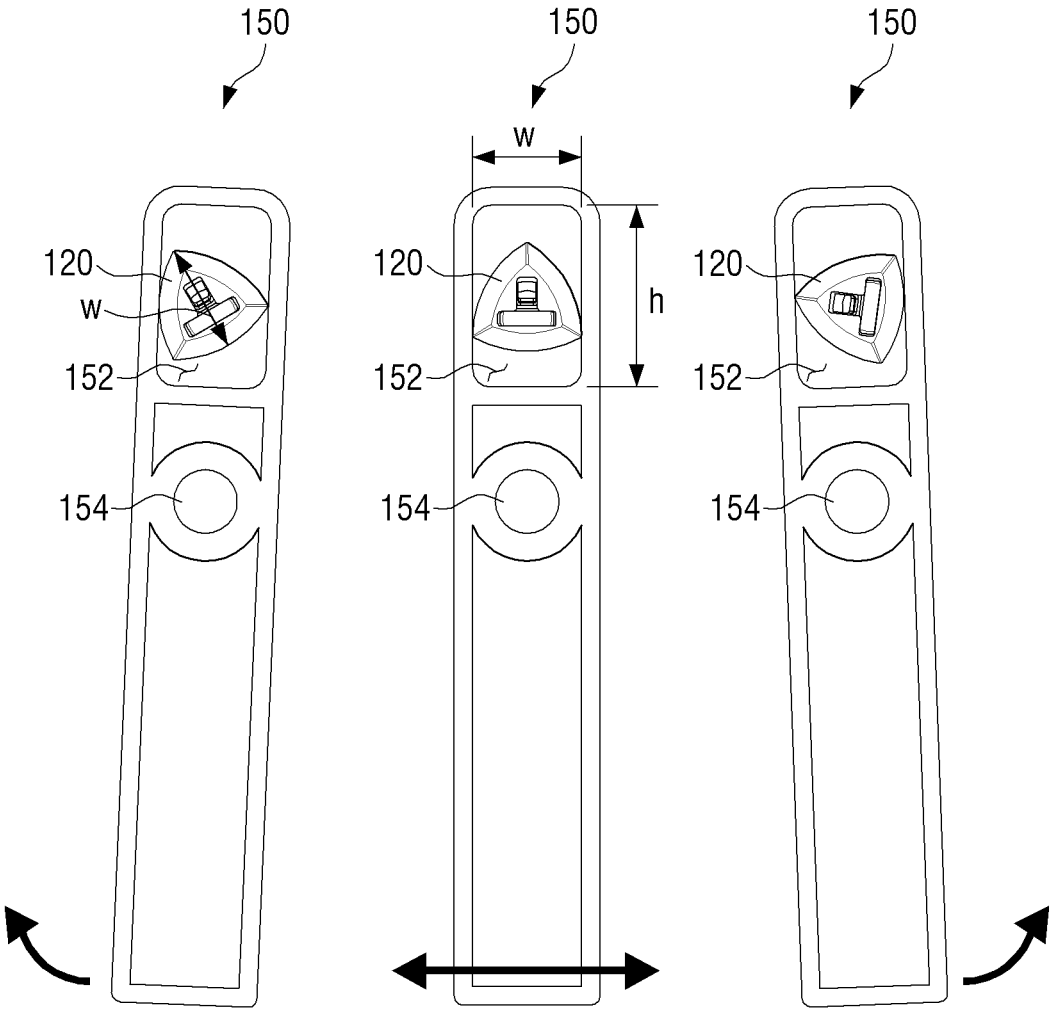
FIG. 6 is a view illustrating driving of a cam member and a swing member of a waste toner collecting device according to an example.

FIG. 6 is a view illustrating driving of a cam member and a swing member of a waste toner collecting device according to an example.

Referring to FIG. 6, the cam hole 152 has a pair of inner side surfaces parallel to each other. When the cam member 120 having the Reuleaux triangle shape is rotated, one vertex forms a trajectory of a quadrangle. Accordingly, the cam hole 152 is formed to have a pair of inner side surfaces parallel to each other. The interval between the pair of inner side surfaces of the cam hole 152 is formed to be equal to the width w of the Reuleaux triangle of the cam member, so that the swing member 150 may contact with the two parts of the cam member 120 simultaneously. The height h of the cam hole 152 is formed to be greater than the width w of the cam member 120 so that the cam member 120 may rotate in the cam hole 152 without being interfered.

The cam member 120 rotates in the cam hole 152 with a fixed rotational center. Driving force is transmitted to the swing member 150, as the cam member 120 rotates. The rotational movement of the cam member 120 is converted to the swing movement of the swing member 150. The cam member 120 of the Reuleaux triangle shape generates a deviation by rotating, and the swing member 150 reciprocates within a certain range with respect to the rotational center 144 of the swing member.

At one end of the swing member 140 according to an example as illustrated in FIG. 5, the cam hole 142 in which the cam member 120 is inserted to be capable of contacting is formed, and at the other end of the swing member 140, the shaking member 160 which will be described later is rotatably coupled.

At a lower end of the cam hole 142, a rotational center 144 of the swing member is formed. The rotational center 144 of the swing member which is rotatably connected to the waste toner bottle 101 is formed to be inclined with respect to the cam hole 142.

The rotational center 144 of the swing member and the rotational center 162 of the shaking member are positioned in a collinear manner, but the cam hole 142 is not positioned in a collinear manner with the rotational center 144 of the swing member and the rotational center 162 of the shaking member 160. The swing member 140 may be formed in a bent shape according to the shape of the waste toner bottle 101.

Figure 7A:
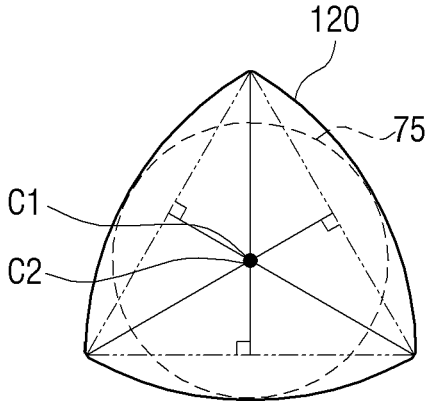
FIGS. 7A and 7B are views illustrating a case where a center of the cam member corresponds to a rotational center of the cam member of the waste toner collecting device and a case where a rotational center of the cam member is eccentrically disposed from the center of the cam member according to an example.
Figure 7B:
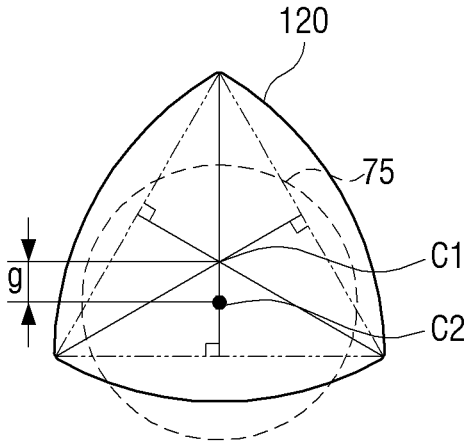

FIGS. 7A and 7B are views illustrating a case where a center of the cam member corresponds to a rotational center of the cam member of the waste toner collecting device and a case where a rotational center of the cam member is eccentrically disposed from the center of the cam member according to an example.

Referring to FIGS. 7A and 7B, the center of the cam member 120 is the center of an equilateral triangle connecting each vertex of the Reuleaux triangle. The rotational center of the cam member 120 is the rotational center of the waste toner conveying auger 75. The rotational center C2 of the cam member is formed to be eccentric to an arc side facing one vertex of the cam member 120. Even when the rotational center C2 of the cam member 120 and the center C1 of the cam member 120 correspond each other due to the shape of the Reuleaux triangle, a deviation is generated and the cam driving is available. The maximum displacement of the reciprocating motion of the swing member 140 varies depending on the positional difference between the center C1 of the cam member and the rotational center C2 of the waste toner conveying auger 75. Accordingly, the cam member 120 may be deformed in a diverse manner to correspond to the applicable image forming apparatuses.

FIG. 7A illustrates that the cam member 120 is coupled to the waste toner conveying auger 75 so that the center C1 of the cam member corresponds to the rotational center C2 of the cam member, and FIG. 7B illustrates that the cam member 120 is coupled to the waste toner conveying auger 75 so that the center C1 of the cam member has a gap (g) with the rotational center C2 of the cam member.

Displacement by the cam member 120 becomes greater as much as the difference (g) in the case where the center C1 of the cam member and the rotational center C2 of the cam member are formed to be eccentric, rather than the case where the center C1 of the cam member corresponds to the rotational center C2.

Figure 8A:
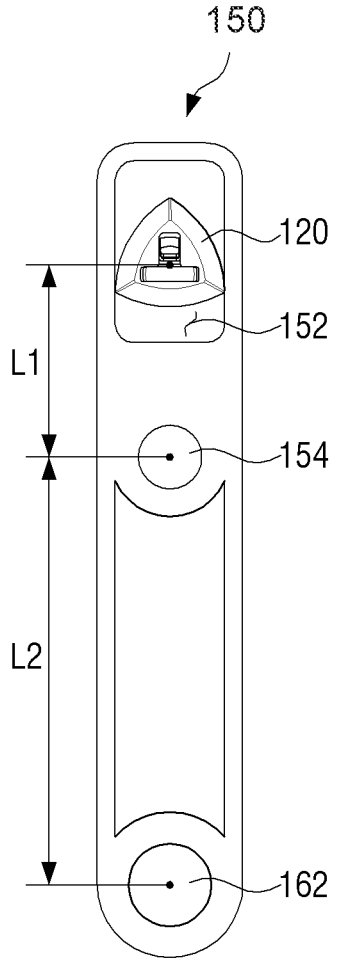
FIGS. 8A and 8B are views illustrating various examples of a swing member of a waste toner collecting device according to an example.
Figure 8B:
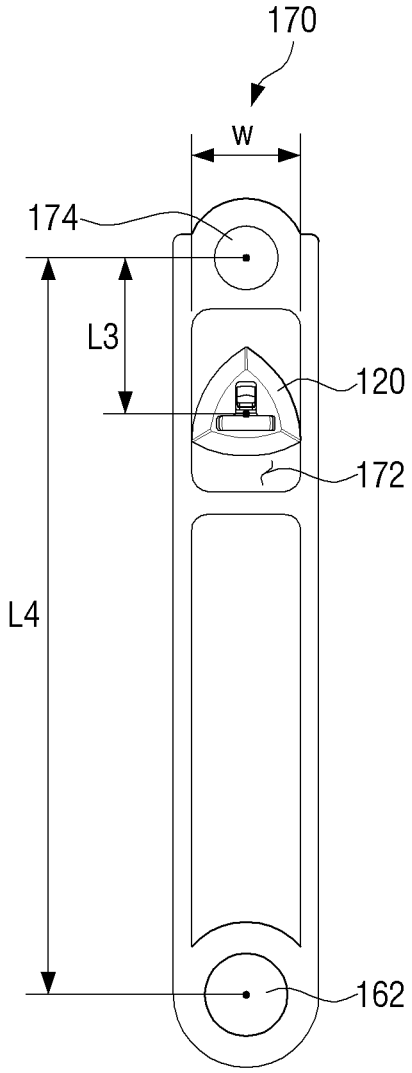

FIGS. 8A and 8B are views illustrating various examples of a swing member of a waste toner collecting device according to an example.

Referring to FIGS. 8A and 8B, unlike the swing member 140 in the bent shape of FIG. 5, the swing members 150, 170 of FIGS. 8A and 8B have a shape of a straight line. Cam holes 152 and 172 of the swing members 150 and 170, the rotational centers 154 and 174 of the swing member, and the first rotational center 162 of the shaking member are disposed in a collinear manner.

The swing member 150 of FIG. 8A has the rotational center 154 of the swing member being located below the position of the cam hole 152. The distance between the rotational center C2 of the cam member 120 and the rotational center 154 of the swing member is L1, and the distance between the rotational center 154 of the swing member and the first rotational center 162 of the shaking member is L2. At this time, the final displacement of the swing member 150 is a value obtained by multiplying the displacement of the cam member by (L2/L1).

As the rotational center 154 of the swing member is positioned below the cam hole 142 and loss of the swing movement of the swing member due to tolerance is small. Accordingly, the effect that the swing member 150 may move with an accurate displacement may be obtained.

In the swing member 170 of FIG. 8B, the rotational center 174 of the swing member is positioned above the position of the cam hole 172. The distance between the rotational center C2 of the cam member 120 and the rotational center 174 of the swing member is L3, and the distance between the rotational center 174 of the swing member and the first rotational center 162 of the shaking member is L4. At this time, the final displacement of the swing member 150 is a value obtained by multiplying the displacement of the cam member by (L4/L3).

The distance L4 between the rotational center 174 of the swing member and the first rotational center 162 of the shaking member of FIG. 8B is greater than the distance L2 between the rotational center 154 of the swing member and the first rotational center 162 of the shaking member of FIG. 8A and thus, the swing member 170 of FIG. 8B swings with a displacement greater than the swing member 150 of FIG. 8A. The swing member 170 of FIG. 8B may obtain a favorable effect in making a swing movement with a large motion than the swing member 150 of FIG. 8A.

Figure 9:
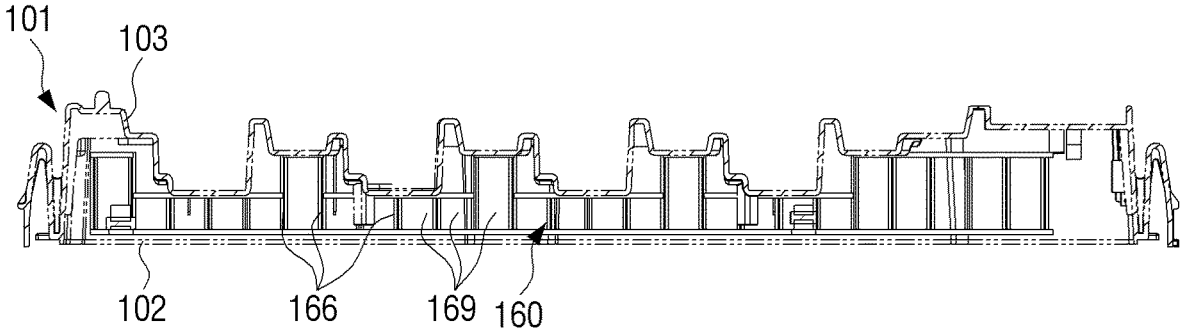
FIG. 9 is a view illustrating a planar surface of the shaking member of FIG. 5.
Figure 10:
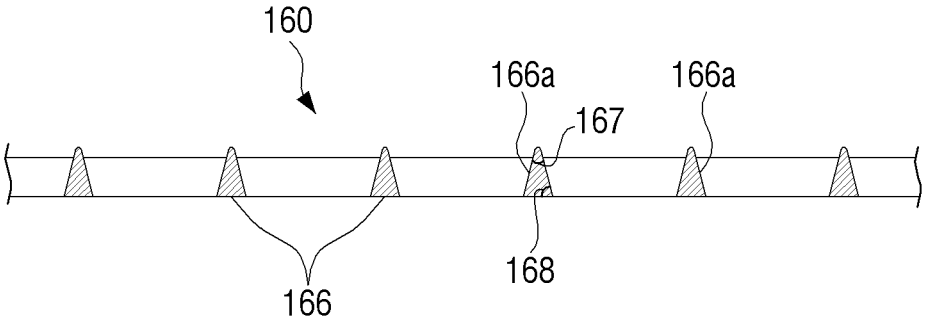
FIG. 10 is a cross-sectional view of a shaking member of a waste toner collecting device according to an example.

FIG. 9 is a view illustrating a planar surface of the shaking member of FIG. 5, and FIG. 10 is a cross-sectional view of a shaking member of a waste toner collecting device according to an example.

The shaking member 160 is for scraping the upper portion of the waste toner heap W2 collected into the waste toner bottle 101 to level the waste toner. The shaking member 160 is disposed to be perpendicular to the swing member 140. That is, the shaking member 160 is disposed along the longitudinal direction of the waste toner bottle 101. The shaking member 160 is formed to extend in the longitudinal direction of the waste toner bottle 101, and the bottom surface 102 is formed in a flat surface. One side of the shaking member 160 is hinge-connected to the swing member 140 and the other side is hinge-connected to the auxiliary swing member 180. The shaking member 160 reciprocates in the waste toner bottle 101 along the longitudinal direction of the waste toner bottle 101.

The auxiliary swing member 180 is swingably disposed in the waste toner bottle 101, with an interval with the swing member 140. The auxiliary swing member 180, connected to the other side of the shaking member 160 at rotational center 164 of the shaking member, assists the reciprocal movement of the shaking member 160.

Referring to FIG. 9, the waste toner bottle 101, having two sides 102, 103, is disposed on the side surface of the image forming apparatus 1 and thus, the waste toner bottle 101 may have a concave and convex shape so as to avoid other devices disposed inside the main body 2. For example, as shown in FIG. 9, the one side 103 of the waste toner bottle 101 has a concave and convex shape. The shaking member 160 is formed to correspond to an internal collection space 104 of the waste toner bottle 101 so as to prevent a dead zone, to which the shaking member 160 may not reach depending on the shape of the waste toner bottle 101, from being generated.

In order for the shaking member 160 to cover the entire collection space 104 of the waste toner bottle 101, the convex shape of the waste toner bottle 101 is formed to protrude toward the other side. The shaking member 160 is formed to have a width to correspond to the width of the waste toner bottle 101 having sides 102, 103.

The shaking member 160 may reciprocate along the longitudinal direction of the waste toner bottle 101 over the entire collection space 104 of the waste toner bottle 101. The shaking member 160 has a flat shape to correspond to the internal shape of the waste toner bottle 101 so that the entire area of the waste toner collecting device 100 may be leveled. Accordingly, leveling may be performed over the entire area of the waste toner bottle 101 evenly.

The shaking member 160 has a lower surface formed to be a flat surface, and is disposed perpendicular to the swing member 140 and the auxiliary swing member 180. That is, the shaking member 160 is horizontally disposed to the bottom surface of the waste toner bottle 101. Since the shaking member 160 has a flat shape and is formed to correspond to the internal shape of the waste toner bottle 101, a separate space for disposing the leveling unit 110 is not needed, and the shaking member 160 is not affected by the shape of the internal space of the waste toner bottle 101 and therefore, there is a benefit that the shaking member 160 may be easily applicable to an existing image forming apparatus.

The shaking member 160 is formed in a ladder shape. For example, the shaking member 160 includes a plurality of scrapers 166 that are disposed with an interval along the direction in which the shaking member 160 swings. Each of a cross section of the plurality of scrapers 166 is in a triangular shape, and a hole 169 is formed between adjacent scrapers 166 among the plurality of scrapers 166. The waste toner is not piled in an upper part of the plurality of scrapers 166 of which the cross section is in a triangular shape and the scrapers 166 in a net shape formed with a plurality of holes 169. Accordingly, the load of the reciprocating movement of the scraper 166 may be reduced.

Referring to FIG. 10, a lower surface of the plurality of scrapers 166 is a flat shape, and the plurality of scrappers 166 include a cross section which is in an isosceles triangle shape. Here, the isosceles triangle has a vertical angle 167 which is formed to be smaller than remaining two base angles 168.

For example, the two base angles 168 of the scraper 166 are formed greater than the repose angle of the waste toner (see FIG. 3). Accordingly, even if the scraper 166 scrapes the upper portion of the waste toner heap, the waste toner is not piled on the shaking member 160, but flows down along a side surface 166*a* of the scraper 166. Accordingly, the waste toner is not piled on the upper surface of the shaking member 160 and thus piling of the waste toner on the shaking member 160 can be avoided, and the load caused by the waste toner received by the shaking member 160 may be minimized.

Figure 11:
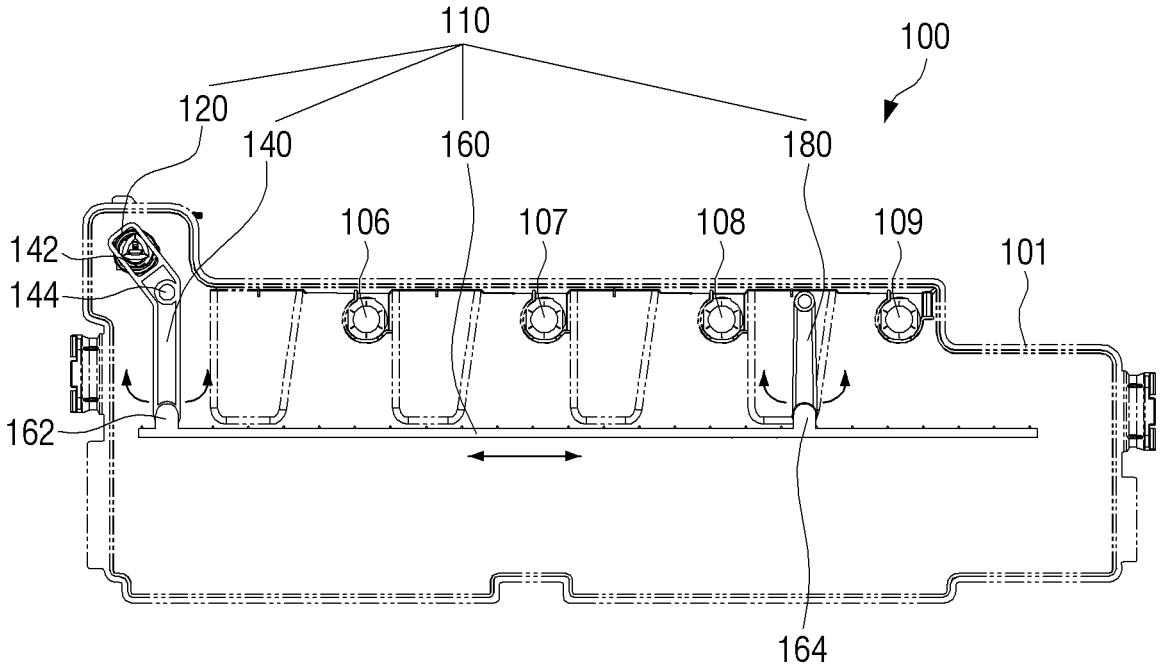
FIG. 11 is a view illustrating an operation of a leveling unit of a waste toner collecting device according to an example.

FIG. 11 is a view illustrating an operation of a leveling unit of a waste toner collecting device according to an example.

Referring to FIG. 11, the waste toner collecting device 100 includes the waste toner bottle 101 and the leveling unit 110. The leveling unit 110 swings to level the waste toner which is collected and piled in the waste toner bottle 101.

The leveling unit 110 includes the cam member 120, the swing member 140, the shaking member 160, and the auxiliary swing member 180. Hereinafter, driving of the leveling unit 110 will be described.

The cam member 120 rotates in the waste toner bottle 101 by the driving force transmitted from the waste toner conveying auger 75, and the swing member 140, which is in contact with the cam member 120, swings in the waste toner bottle 101 by rotation of the waste toner bottle 101. One side of the shaking member 160 is hinge-connected to the swing member 140, and the other side is hinge-connected to the auxiliary swing member 180. Accordingly, the shaking member 160 may reciprocate linearly by the swing movement of the swing member 140. The auxiliary swing member 180 swings according to the reciprocating movement of the shaking member 160. The auxiliary swing member 180 swings in order to assist the shaking member 160 to reciprocate within the waste toner bottle 101.

The shaking member 160 reciprocates along the longitudinal direction of the waste toner bottle 101 by the swing of the swing member 140, and the shaking member 160 may reciprocate linearly without being leaned toward the bottom of the toner bottle 101 by the auxiliary swing member 180. The shaking member 160 may reciprocate along the longitudinal direction of the waste toner bottle 101 by the structure of the swing member 140 and the auxiliary swing member 180. The leveling unit 110 moves while drawing an arc along the radius of gyration of the swing member 140, when the shaking member 160 makes a reciprocating movement.

By gravity, the swing member 140 and the shaking member 160 return to their basic positions. Here, the basic position refers to the initial position of the image forming apparatus in which the cam member 120 and the swing member 140 may be coupled. At the time of mounting or detaching the waste toner collecting device 100, the leveling unit 110 is disposed at a basic position by gravity. Accordingly, when the waste toner collecting device 100 is mounted again, it is easy to assemble the cam member 120 at a home position.

Figure 12:
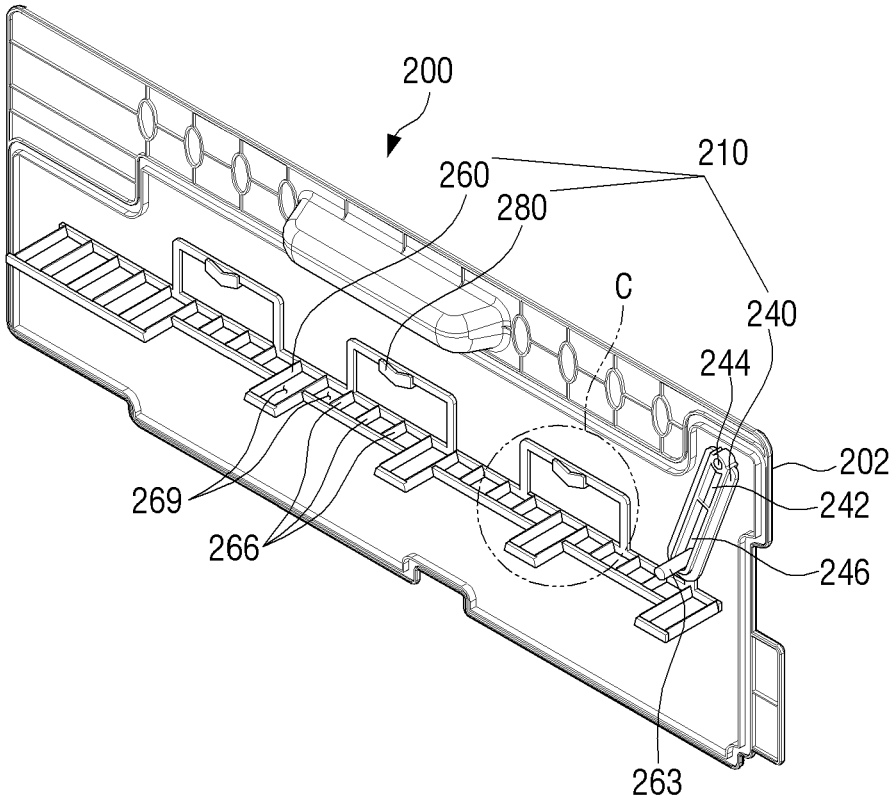
FIG. 12 is a perspective view illustrating a waste toner collecting device according to an example.
Figure 13:
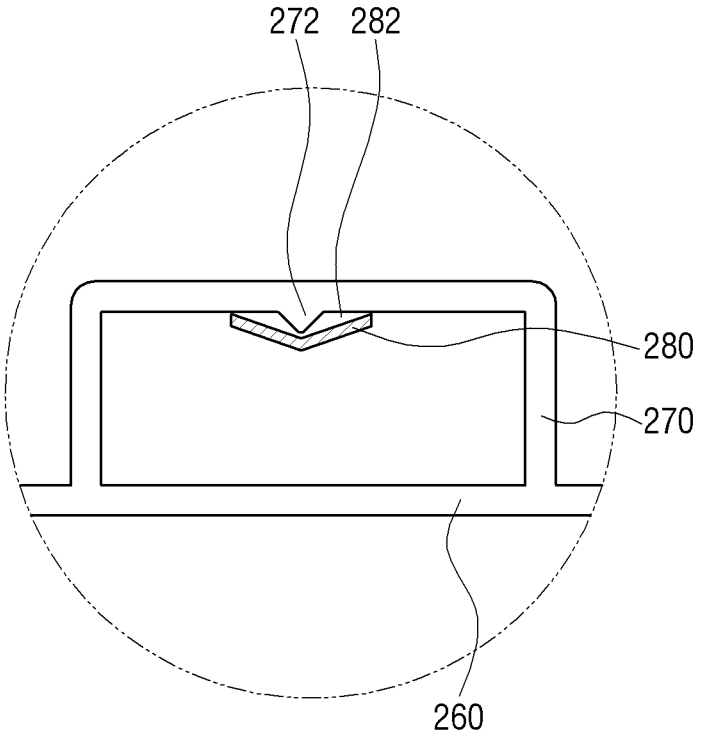
FIG. 13 is an enlarged cross-sectional view illustrating C of FIG. 12.

FIG. 12 is a perspective view illustrating a waste toner collecting device according to an example and FIG. 13 is an enlarged cross-sectional view illustrating C of FIG. 12.

A waste toner collecting device 200 according to an example of FIG. 12 is different from the waste toner collecting device 100 according to an example of FIG. 5 in terms of a leveling unit 210.

Referring to FIG. 12, the leveling unit 210 includes a supporting protrusion 280 instead of the auxiliary swing member, unlike the leveling unit 110 according to an example which includes the auxiliary swing member 180.

The leveling unit 210 includes a swing member 240, a cam member (not shown), a shaking member 260, and the supporting protrusion 280. The cam member (not shown) is the same as the cam member 120 of the leveling unit 110 according to an example, and a description of the cam member (not shown) will be omitted. The cam member (not shown) is formed in a second case 202 of the waste toner bottle 201 and is not illustrated in FIG. 13.

The swing member 240 has a rotational center 244 and includes a cam hole 242, in the same manner as the swing member 180 of the leveling unit 110 according to an example. Meanwhile, the swing member 240 has a fixing hole 246, which is hinge-connected to the shaking member 260, formed along the longitudinal direction of the swing member 240. The shaking member 260 is coupled to the swing member 240 via protrusion 263 so as to move for a predetermined distance along the fixing hole 246 of the swing member 240. Accordingly, the shaking member 260 reciprocating without the auxiliary swing member may make a reciprocating movement without interference with the swing member 240.

The supporting protrusions 280 are formed to protrude from an inner wall of the second case 202 of the waste toner bottle 201. The supporting protrusions 280 have the same role as the auxiliary swing members. The supporting protrusion 280 guides the shaking member 260 to reciprocate in the waste toner bottle 201 along the longitudinal direction of the waste toner bottle 201.

One side of the shaking member 260 is hinge-connected to the swing member 240 and the other side is slidably supported on the supporting protrusion 280. The shaking member 260 reciprocates in the longitudinal direction of the waste toner bottle 201 by the swing driving force of the swing member 240. The other side of the shaking member 260 slides in a reciprocal manner along the longitudinal direction of the waste toner bottle 201 by the supporting protrusion 280.

The shaking member 260 is formed in a ladder shape in the similar manner as the shaking member 160 according to an example. For example, the shaking member 260 includes a plurality of scrapers 266 disposed with intervals along the direction in which the shaking member 260 swings, and the hole 269 is formed between the scraper 266 adjacent to each other among the plurality of scrapers 266. In addition, the shaking member 260 according to another example further includes a sliding portion 270 that is slidably seated in the supporting protrusion 280. The sliding portion 270 is formed in a ring shape perpendicular to the scraper 266. The sliding portion 270 assists the shaking member 260 to linearly reciprocate within the waste toner bottle 201.

Referring to FIG. 13, the supporting protrusions 280 are formed in a V shape, and the supporting protrusions 280 are formed with a regulating groove 282 for regulating the reciprocating movement of the shaking member 260. The sliding portion 270 includes a locking protrusion 272 protruding from the upper portion of the sliding portion 270. The locking protrusion 272 is disposed in the regulating groove 282. The locking protrusion 272 is formed in a shape of a v smaller than the shape of the regulating groove 282. The locking protrusion 272 slides within a range regulated by the regulating groove 282. By this structure, the shaking member 260 may reciprocate along the longitudinal direction of the waste toner bottle 201 without the other side which is opposite to the one side connected to the swing member 240 being tilted.

The leveling unit 210 is fixed to the basic position by the locking protrusion 272 formed on the sliding portion 270, when the waste toner collecting device 200 is mounted or detached. When the waste toner collecting device 200 is re-mounted, it is easy to assemble the swing member 240 fixed to the basic position and the cam member (not shown) connected to the image forming apparatus 1.

Figure 14:
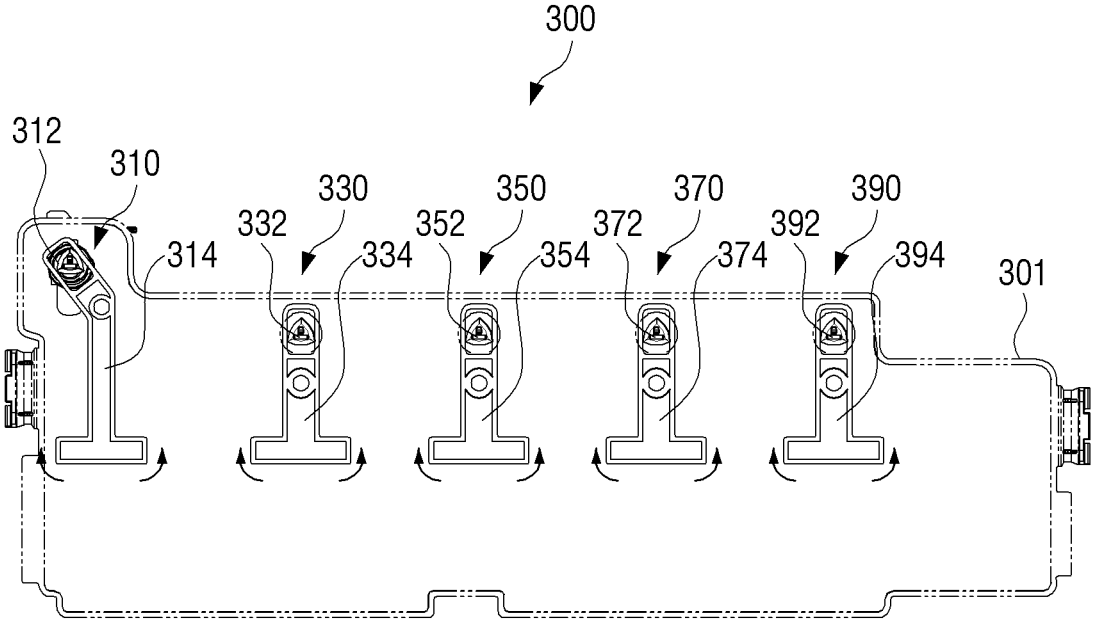
FIGS. 14 to 16 are front views illustrating a waste toner collecting device according to examples.

FIG. 14 is a front view illustrating a waste toner collecting device according to an example.

Referring to FIG. 14, in a waste toner bottle 301 of a waste toner collecting device 300 according to an example, a plurality of waste toner inlet holes are formed, and cam members 312, 332, 352, 372, and 392 are plural to correspond to the plurality of waste toner inlet holes, respectively, and the swing members 314, 334, 354, 374, and 394 are plural to be swingably connected to the cam members 312, 332, 352, 372, and 392, respectively.

In an example, waste toners discharged from the plurality of waste toner inlet holes are leveled using the shaking member 160, whereas, in another example, a plurality of leveling units 310, 330, 350, 370, and 390 are installed to correspond to each of the waste toner inlet holes.

Each of the plurality of leveling units 310, 330, 350, 370, and 390 are driven independently, and in this case, the leveling units are driven by an existing source of driving force in the image forming apparatus, and not by a separate source of driving force.

The first leveling unit 310 includes a cam member 312 coupled to the waste toner conveying auger 75 driven by the intermediate transfer belt 45 as in one example. The cam members 332, 352, 372 and 392 of the second to fifth leveling units 330, 350, 370 and 390 are coupled to the waste toner conveying augers 71, 72, 73 and 74 driven by the photosensitive bodies 41, 42, 43, and 44, respectively.

The cam members 312, 332, 352, 372 and 392 are rotated in the waste toner bottle and are in contact with one side of the swing members 314, 334, 354, 374 and 394 to swing the swing members 314 and 334, 354, 374, and 394. At this time, a shaking portion may be formed on the other side of the swing members 314, 334, 354, 374, and 394 to serve as a shaking member. The shaking portion is formed to extend along the longitudinal direction of the waste toner bottle 301. The shaking portion is integrally formed with the swing members 314, 334, 354, 374, and 394.

The waste toner discharged from each of the waste toner inlet holes is piled in the waste toner bottle 301 by forming a shape of a cone, and the leveling units 310, 330, 350, 370, and 390 disposed in each of the waste toner inlet holes are swinging and scrape the upper portion of the waste toner heap, so that the waste toner collecting efficiency of the waste toner collecting device is improved.

Figure 15:
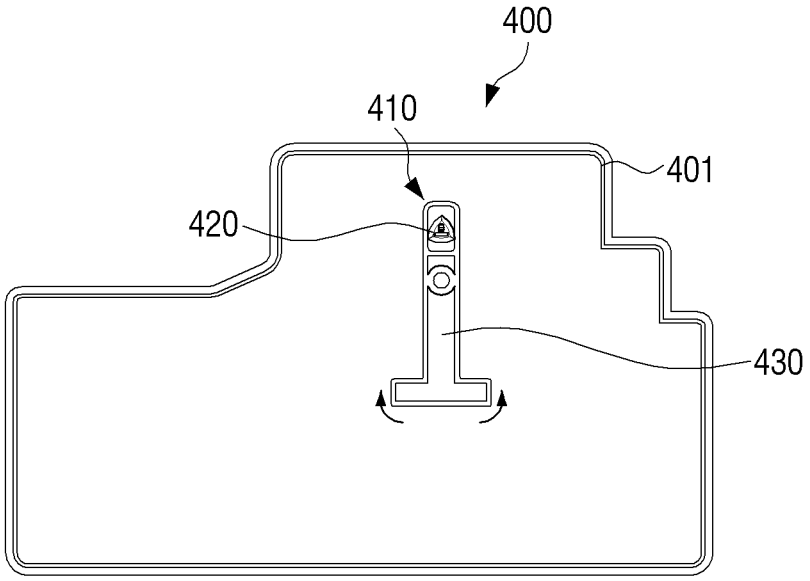

FIG. 15 is a front view illustrating a waste toner collecting device according to an example.

Referring to FIG. 15, a waste toner collecting device 400 according to an example is applicable to a mono type image forming apparatus. The waste toner inlet hole is formed as a single hole, and there is one toner discharge point. In this case, even if the upper portion of the waste toner piled in the toner discharge area is scraped, the collection efficiency of the waste toner collecting device 400 may be improved. The leveling unit 410 of FIG. 15, unlike the leveling unit 110, is composed of the cam member 420 and the swing member 430, without a shaking member and an auxiliary swing member.

The cam member 420 rotates within the waste toner bottle and comes into contact with one side of the swing member 430 to cause the swing member 430 to swing. At this time, a shaking portion may be formed on the other side of the swing member 430 to serve as a shaking member. The shaking portion is formed to extend along the longitudinal direction of the waste toner bottle 401. The shaking portion is formed integrally with the swing member 430.

Figure 16:
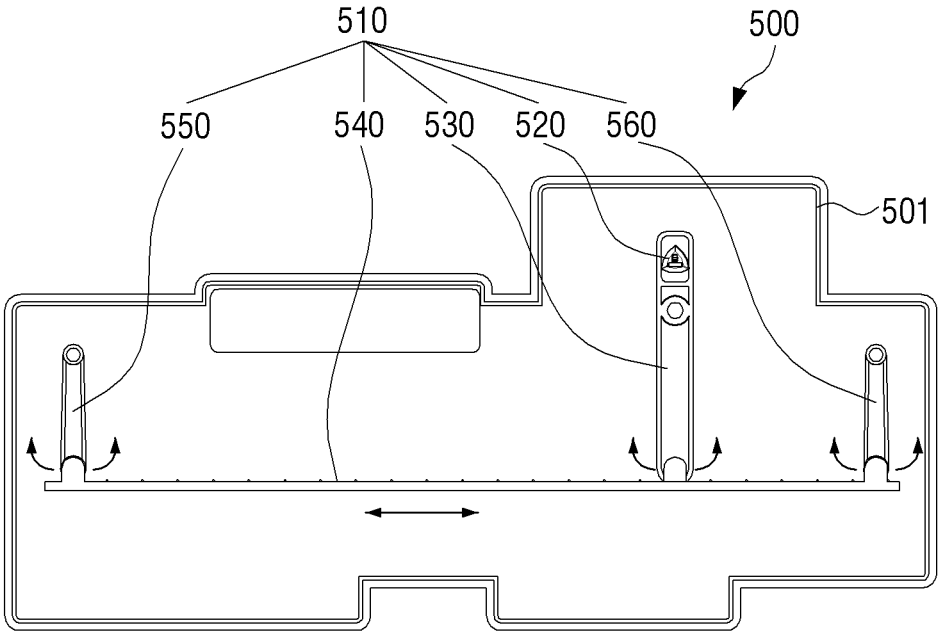

FIG. 16 is a front view illustrating a waste toner collecting device according to an example.

Referring to FIG. 16, in a waste toner collecting device 500 according to an example, the waste toner inlet holes are formed as a single unit, in the same manner as the example of FIG. 15, and there is one waste toner discharge point. However, in order to increase the service life of the waste toner collecting device 500, the length of the waste toner bottle 501 is elongated. In this case, in order to fully utilize the entire space of the waste toner bottle 501, the shaking member 540 and the auxiliary swing members 550 and 560 are included as in the waste toner collecting device 100 according to one example, and the whole area of the waste toner bottle 501 may be leveled.

The leveling unit 510 includes a swing member 530 which is swingably disposed in the waste toner bottle 501, the cam member 520 which is in contact with the swing member 530 to swing the swing member, a pair of auxiliary swing members 550 and 560 which are swingably disposed with an interval with the swing member 530 in the waste toner bottle 501, and the shaking member 540 of which a part is hinge-connected to the swing member 530, both ends are hinge-connected to the auxiliary swing members 550 and 560, and which scrapes the upper portion of the waste toner heap which is connected into the waste toner bottle.

The disclosure has been shown and described with reference to various examples. The terminology used herein is for description and should not be construed as limiting. Various modifications and variations are possible in accordance with the above teachings. Therefore, unless stated otherwise, the disclosure can be practiced freely within the scope of the claims.

The invention claimed is:

1. A waste toner collecting device, comprising:
a waste toner bottle to collect a waste toner; and
a leveling unit, disposed inside the waste toner bottle, the leveling unit including:
a swing member swingably disposed inside the waste toner bottle to swing inside the waste toner bottle to thereby cause waste toner collected inside the waste toner bottle to be leveled, and
a shaking member to scrape an upper portion of the waste toner collected inside the waste toner, having one side hinge-connected to the swing member and another side connected to one of an auxiliary swing member swingably disposed inside the waste toner bottle and spaced apart from the swing member or a supporting protrusion which protrudes from an inner wall of the waste toner bottle.

2. The waste toner collecting device of claim 1, wherein
the leveling unit further includes a cam member to rotate inside the waste toner bottle and to swing the swing member by contacting the swing member.

3. The waste toner collecting device of claim 2, wherein the swing member is rotatably connected to the waste toner bottle, and comprises a cam hole into which the cam member is inserted.

4. The waste toner collecting device of claim 1, wherein
the leveling unit includes the auxiliary swing member, and
the another side of the shaking member is hinge-connected to the auxiliary swing member.

5. The waste toner collecting device of claim 4, wherein the shaking member comprises a plurality of scrapers, each of the plurality of scrapers being spaced apart from one another along a swinging direction of the swing member.

6. The waste toner collecting device of claim 2, wherein the cam member has a shape of a Reuleaux triangle.

7. The waste toner collecting device of claim 6, wherein a rotational center of the cam member is eccentrically disposed from a center of the cam member.

8. The waste toner collecting device of claim 7, wherein
the swing member comprises a cam hole into which the cam member is inserted, and
a width between inner side surfaces of the cam hole is equal to a width of the Reuleaux triangle of the cam member.

9. The waste toner collecting device of claim 2, wherein the cam member is connectable to an end of a waste toner conveying auger.

10. The waste toner collecting device of claim 1, wherein
the leveling unit includes the supporting protrusion, and
the another side of the shaking member is slidably connected to the supporting protrusion.

11. The waste toner collecting device of claim 10, wherein the shaking member includes a sliding portion slidably seated on the supporting protrusion.

12. The waste toner collecting device of claim 11, wherein
the supporting protrusion includes a regulating groove to regulate a reciprocating movement of the shaking member, and
the sliding portion includes a locking protrusion to slidably move in the regulating groove.

13. A waste toner collecting device, comprising:
a waste toner bottle to collect a waste toner, the waste toner bottle including a plurality of waste toner inlet holes; and
a leveling unit, disposed inside the waste toner bottle, the leveling unit including:
a plurality of cam members to rotate inside the waste toner bottle, each cam member among the plurality of cam members corresponding to a waste toner inlet hole among the plurality of waste toner inlet holes, and a plurality of swing members disposed inside the waste toner bottle, each swing member among the plurality of swing members being connected to a respective cam member, among the plurality of cam members, which is to swing the swing member to thereby cause waste toner collected inside the waste toner bottle to be leveled.

14. An image forming apparatus, comprising:

an image forming unit;

a waste toner conveying auger; and a waste toner collecting device to collect waste toner generated by the image forming unit and conveyed by the waste toner conveying auger from the image forming unit to the waste toner collecting device, the waste toner collecting device including:

a waste toner bottle to collect the waste toner, and a leveling unit, including:

a swing member to receive a driving force transferred from the waste toner conveying auger to cause the swing member to swing inside the waste toner bottle, and a shaking member to scrape an upper portion of the waste toner collected inside the waste toner, having one side hinge-connected to the swing member and another side connected to one of an auxiliary swing member swingably disposed inside the waste toner bottle and spaced apart from the swing member or a supporting protrusion which protrudes from an inner wall of the waste toner bottle.

15. The image forming apparatus of claim 14, wherein the leveling unit includes the auxiliary swing member and a cam member to rotate inside the waste toner bottle and to swing the swing member by contacting the swing member, and the another side of the shaking member having is hinge-connected to the auxiliary swing member.

16. The image forming apparatus of claim 14, wherein the leveling unit includes the supporting protrusion and a cam member to rotate inside the waste toner bottle and to swing the swing member by contacting the swing member, and the another side of the shaking member is slidably connected to the supporting protrusion.

* * * * *